US005909971A

United States Patent [19]

Tijanic

[11] Patent Number: 5,909,971

[45] **Date of Patent: *Jun. 8, 1999**

[54] DISPLAY DEVICE WITH DISK AND LED

[75] Inventor: Veso S. Tijanic, Mississauga, Canada

[73] Assignee: Mark IV Industries Limited, Mississauga, Canada

[ * ] Notice: This patent is subject to a terminal disclaimer.

[21] Appl. No.: 09/065,572

[22] Filed: Apr. 24, 1998

Related U.S. Application Data

[63] Continuation of application No. 08/684,064, Jul. 19, 1996, Pat. No. 5,771,616.

[51] Int. Cl.[6] ..... G09F 9/37

[52] U.S. Cl. ..... 40/449; 340/908; 40/452

[58] Field of Search ..... 40/447, 449, 450, 40/451, 452; 340/764, 815.86, 815.56, 472, 473, 484, 485, 907, 908, 927, 930

[56] References Cited

U.S. PATENT DOCUMENTS

| | | | |
|---|---|---|---|
| 4,531,318 | 7/1985 | Chang et al. | 40/449 |
| 4,577,427 | 3/1986 | Browne | 40/449 |
| 4,860,470 | 8/1989 | Browne | 40/449 |
| 4,974,353 | 12/1990 | Norfolk | 40/447 |
| 5,005,305 | 4/1991 | Turney et al. | 40/449 |
| 5,021,773 | 6/1991 | Browne | 340/764 |
| 5,022,171 | 6/1991 | Norfolk et al. | 40/447 |
| 5,050,325 | 9/1991 | Browne | 40/447 |
| 5,055,832 | 10/1991 | Browne | 340/764 |

FOREIGN PATENT DOCUMENTS

| | | | |
|---|---|---|---|
| 0556954 | 8/1993 | European Pat. Off. . | |
| 3916283 | 11/1989 | Germany . | |
| WO94/07231 | 3/1994 | WIPO | 40/449 |

*Primary Examiner*—Joanne Silbermann
*Attorney, Agent, or Firm*—Robert Westell; Dowell & Dowell, P.C.

[57] ABSTRACT

A display element has a disk which rotates on an axis to show its bright or dark side in the viewing direction. When the bright side is showing the disk allows passage of light from an LED. When the dark side is showing the disk masks the light from the LED. Preferably, an opaque shroud surrounds the LED and projects a short distance forwardly thereof to help define the cone in which light from the LED may be viewed in ON position. A side wall of said element projects forwardly of the rotation axis to mask the escape of light on that side transverse to the viewing direction. A second side wall may be placed on the other side for the same purpose or the adjacent element may provide the second wall.

3 Claims, 5 Drawing Sheets

FIG.5.
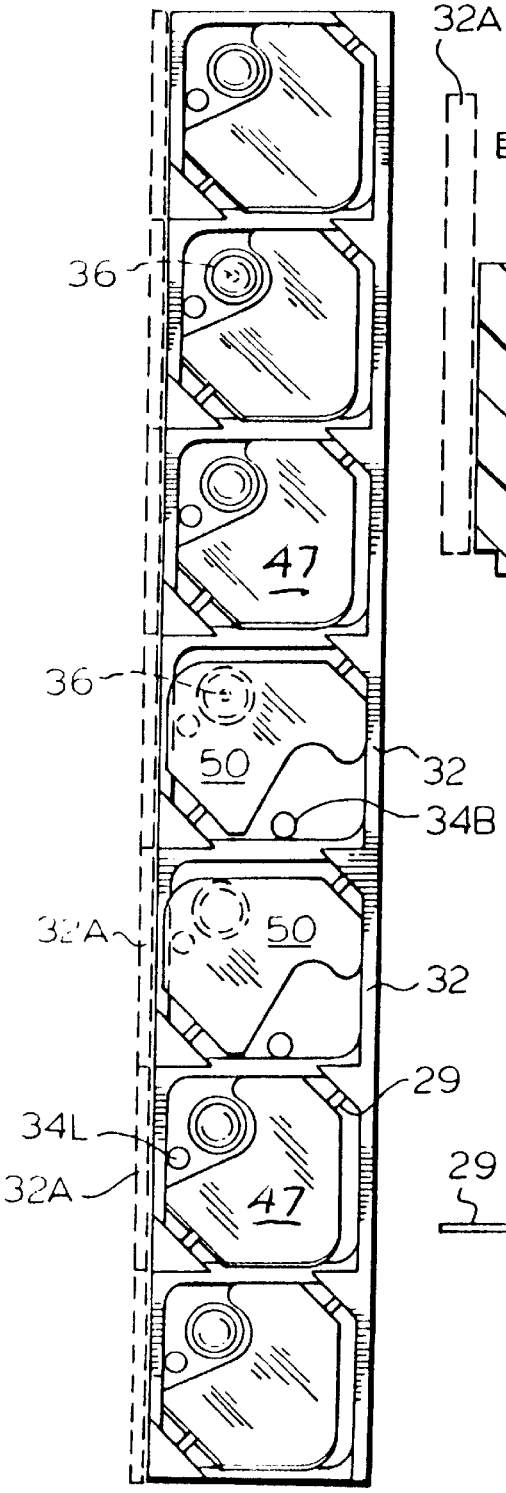
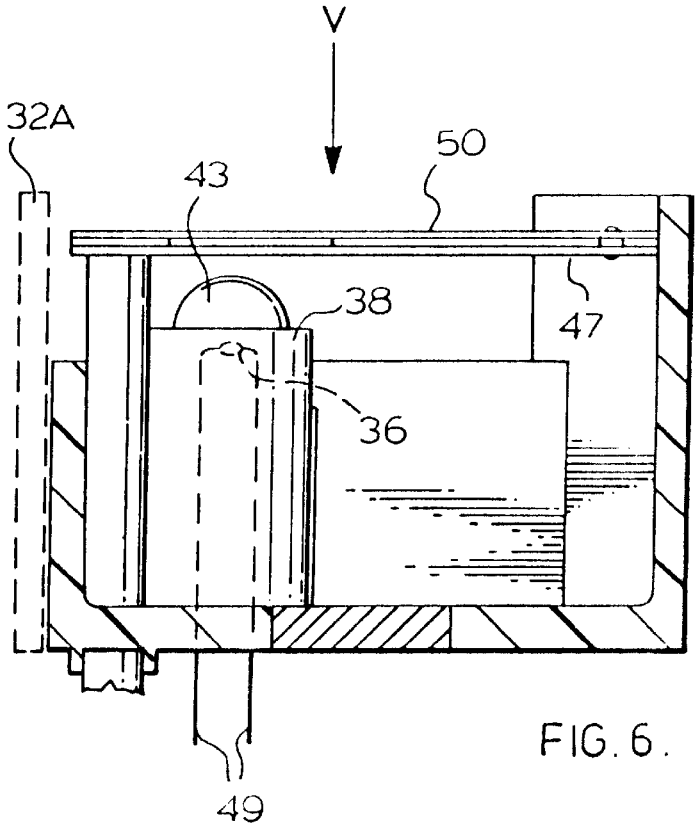
FIG. 6.
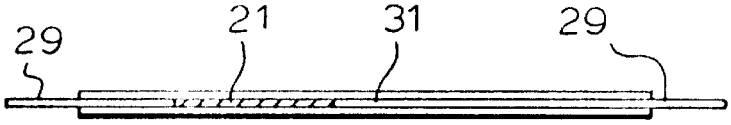
FIG.7.

DISPLAY DEVICE WITH DISK AND LED

This application is a Continuation of application Ser. No. 08/684,064 filed Jul. 19, 1996, now U.S. Pat. No. 5,771,616.

This invention relates to a display element which may be used alone as an indicator but will be more commonly used as a pixel in an array of such elements to form a changeable display sign. The invention will be found particularly useful for signs and displays which must be viewed over wide angles such as bus destination signs. (As distinct from signs for narrow angle viewing such as road signs).

The display element is of the type using a rotor disk defining a median plane, having opposed sides which respectively contrast and conform with their background, and which is rotatable about a rotation axis approximately parallel to said median plane to display the bright or dark sides of the disk in a viewing direction which is considered the axis of a viewing cone (not necessarily a surface of revolution) which surrounds the viewing direction. The stator which forms the background to each disk is coloured darkly to contrast with the disk bright side; and conform to the disk dark side. The bright and dark sides are displayed in the ON and OFF respective positions.

A light emitting diode (LED) corresponding to each disk is positioned to form part of the disk's pixel when the bright side is displayed (called the ON position) the LED being positioned to project or preferably to shine through a cut-out in the disk when oriented to ON position. The LED is permanently on so must be masked in the OFF position.

'Forward' and 'rearward' are respectively, the directions from the display element toward the viewer, and the opposite direction. 'Higher' and 'lower' correspond respectively to 'forward' and 'rearward'.

An 'array' is the entire bus sign or other sign, composed of 'sub arrays' which are each made up of a column of individual display elements.

Reference to an 'LED' herein is intended to include a cluster of such LED's.

The 'viewing direction' is the general centre of the locations (projected on a plane perpendicular to the viewing direction) from which the display element, or any array thereof, is intended to be viewed.

The 'viewing cone' surrounds the viewing direction and includes the projections on such plane of the positions from which the display element, or an array thereof is intended to be viewed.

It is known to use such a disk augmented by the end of an optic fibre. See for example patents:

U.S. Pat. No. 4,974,353 dated Dec. 4, 1990, Norfolk

U.S. Pat. No. 5,022,171 dated Jun. 11, 1991, Norfolk, et al

U.S. Pat. No. 5,055,832 dated Jun. 8, 1991, Browne

However, optic fibres while suitable for relatively narrow angle viewing are not so suitable for viewing over wide angles, as are LED's. Moreover, LED's are cheaper to a sufficiently marked degree, that a display application with LED's may be practical where a similar application with fibres would be impractical.

Other patents have used LED's with a rotating disk. See for example, U.S. Pat. No. 5,050,325 dated Sep. 24, 1991. However, this patent does not provide for masking of the LED by the disk per se nor for wide angle viewing. Hence the LED had to be switched off in OFF state. The design of the present display element assumes that the LED will be continuously on while the disk switches between ON and OFF positions, thus avoiding the cost of individual switching circuitry for each LED. Such switching requires design complexity and expense.

Accordingly, it is an object of this invention to provide a display element, for use alone or in display of such elements, wherein the appearance of a rotatable flip disk is augmented in ON orientation by an LED, which LED must be masked by the disk, to the viewer, in OFF orientation.

It is an object of this invention to provide a display element allowing, in ON position, viewing over a wide angular range and in OFF position masking the rays over a wide angular range.

It is an object of this invention to provide a display element wherein the light source used is markedly maintenance free and inexpensive in contrast to alternate designs.

It is an object of this invention to provide a display element for forming a pixel which is suitable for relatively large multiple pixel arrays (for example, of 20 by 40 pixels) to provide good definition in the sense of providing a small pixel relative to the size of the array and a pixel having a relatively large effective area.

By 'effective area' I mean the percentage of the sign area which is occupied by the bright areas of the disks when all are ON. This is a measure of the sign's efficiency even though it may not be strictly accurate in view of the effects of the visible presence of LED's and the preferred angle of the disk bright panels to the viewing direction. The need to have as large an effective surface as possible renders preferable the use of rectilinear elements since these tend to have the best 'packing factor' and hence provide the largest ON area in a display. The need to supply pixels, small in area relative to the size of the array, suggests, therefore, the use of square pixels.

Viewing direction is measured perpendicular to the plane of the array, or in the intended direction for a single element.

The invention therefore provides in one aspect, a display element for viewing in locations defining a viewing direction and having a rotor and a stator, where the stator is preferably an open front housing usually of approximately square shape, and an LED located on and projecting in front of the base and located to be viewed in the viewing direction and by viewers located in the viewing cone therearound. There is a rotor mounted on the housing rotatable about an axis forming an approximate diameter of such a square. The rotor comprises a disk defining a median plane and having a bright side and a dark side. A drive, preferably electromagnetic, selectively causes rotation of said disk about through an angle of between 160° and 180° about said axis between ON and OFF orientations, where said bright and dark sides are, respectively, visible in said viewing direction. Such disk may be considered a near planar lamina when viewed in the viewing direction, which may be considered as two planar semi-lamina sectors on opposite sides of the rotary axis.

One semi-lamina of the disk is provided, contoured in ON orientation, to provide a cut-out to allow the passage of light, in the viewing direction, and to define the projection of the viewing cone. The cut-out sector is also shaped to allow the disk, in rotation between ON and OFF position, to clear components, such as electromagnetic drive cores, and the LED; which would be otherwise encountered in the travel of the disk between ON and OFF position.

In a preferred form of the invention, a shroud is provided preferably located a short distance forward of the LED to shape the cone of light therefrom. (The LED is typically mounted in a lens and the shroud located as above, surrounds a rearward portion of the lens.)

The LED and the disk are arranged to allow the LED in ON position to be visible over a viewing cone comprising as wide an angle as possible, particularly having regard to the intended array use as a bus destination sign. Limitations on the width of the included cone angle are set by the undesirability of having random reflections of LED light from the sign mounting and by the necessity of masking the LED (which is always on) in the OFF position of the disk. For these reasons, the viewing cone is usually limited to an angle of about 45° to the viewing direction, that is, the cone has about a 90° included angle. The cone is not necessarily a surface of revolution since the surrounding components which limit its spread are not symmetrically disposed about the intended viewing direction. The cone boundaries are usually defined by the point at which the light intensity is one half that in the the viewing direction.

The shroud sets a suitable limit for undesired lateral and backward radiation from the LED.

In a preferred form of the invention, the base forming the LED mount is provided with side walls and where the side walls are forward of the pivot axis, the better to mask the sideways escape of rays from the housing when in the OFF position, the LED is masked by the disk in the viewing direction. The rays potentially escaping include, not only those attempting to follow a direct path, but those reflected back from the (then rearwardly turned) bright face of the disk.

In the preferred use of the array, there is not as much concern about upward escape of wide rays from about the OFF disk since a bus is seldom viewed from that angle. Downward escape of wide rays is, to a large degree prevented by components of the next disk below in the array. The escape of wide LED radiation in the OFF position of the disk is further lessened by providing a first side wall extending respectively to an edge forward and an edge rearward. With such arrangement, in OFF position, the disk is forward of a second or shorter side wall opposed to the first side wall which has outward thereof a taller first side wall, so that escaping light must follow a labyrinthine reflective path.

With reference to the first side wall where columns of such display elements are side by side, a single high side wall is used in that role for each of two side by side column elements so that each element requires only one first side wall.

With the second side wall, the edge of the disk which is near to a shorter side wall in OFF orientation, may be shaped to partially overlie it to further mask wide escaping light. It will be noted that the combination of the second and adjacent first side wall provides a stepped arrangement which, in combination with the disk edge provides a labyrinthine escape path for light.

In a preferred form of the invention, the stop is arranged so that said disk, in OFF orientation, has its cut out sector rearward of the axis of rotation, thus improving the restriction on the escape of reflected rays.

In a preferred form of the invention, the disk contains a magnet with its polar axis arranged transversely to the rotation axis and a major portion of such magnet is on the full semi-lamina. In such arrangement, the cut-out semi-lamina is usually down in ON position. In such arrangement, the disk must oppose gravity in turning from ON to OFF. Arranging the stop to lessen the ON position disk angle to the viewing direction provides extra magnetic torque for movement in this direction.

In drawings which illustrate a preferred embodiment of the invention:

FIG. 5 shows a column of the elements of FIG. 1;

FIG. 6 shows a section taken along the lines 6—6 of FIG. 3;

FIG. 7 is a section taken along the lines 7—7 of FIG. 3;

Figure 8:
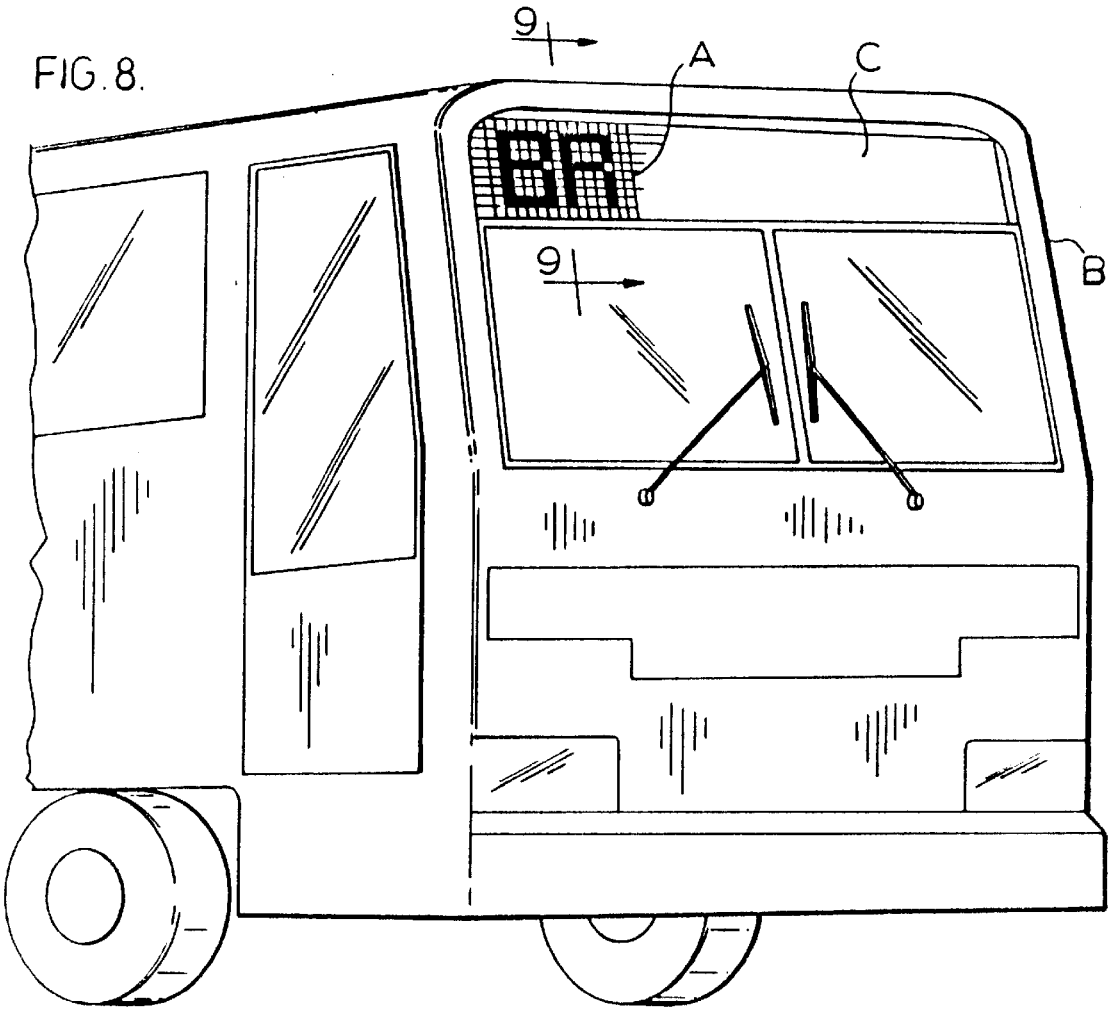
FIG. 8 shows a bus with a display element array.
Figure 9:
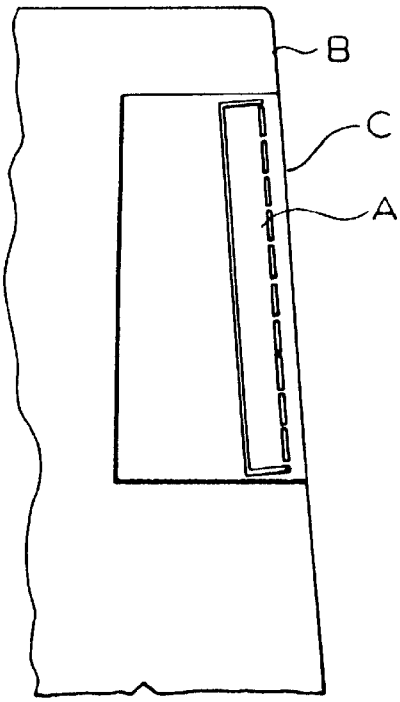
Figure 10A:
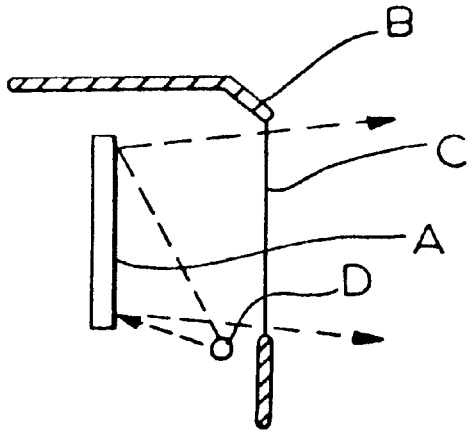
FIG. 10A. (PRIOR ART)
Figure 10B:
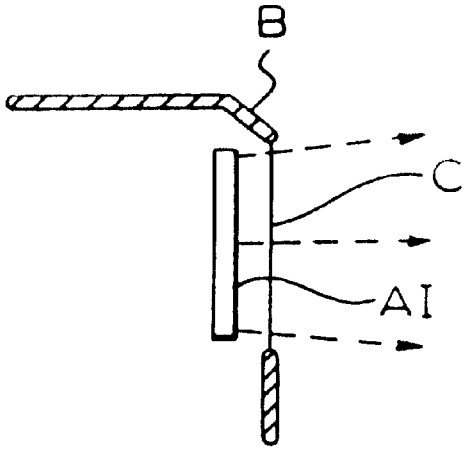

FIG. 9 demonstrates a section on 9—9 of FIG. 8;

FIGS. 10A and 10B show schematically arrays mounted in buses. FIG. 10A shows the arrangement of a prior art array, without LED's and FIG. 10B shows an inventive array with LED's.

In the FIG. 8 is shown a portion of a bus B containing an array A, of pixels of the type shown herein and showing a destination starting with the letters 'BR'. FIG. 9 indicates that the letters are made up of arrays of display elements. The drawing is schematic only and does not show a typical bus destination sign which might be, for example, 20 pixels high and 40 pixels wide.

FIGS. 1–4 and 6 show a display element comprising, a substantially square base 20 and short walls 22S projecting forwardly therefrom including one short side wall 22S ('second side wall') and opposed end walls 22 E. Towers 24 project from diametrically opposed corners of the array. In the preferred orientation of the display element, the towers 24 are located in the upper right and lower left corners of the array and provide mutually facing wells 26 to receive the spindles 28 of the disk 30. The wells 26 thus define the axis of rotation of the disk 30. It will be noted that such axis is located forwardly of short walls 22S and rearwardly of the forward extremities of towers 24.

Opposing short side wall 22S (second side wall) a longer side wall 32 (first side wall) is provided, on the side opposite side 22S, of about the height (forward direction projection from the base) of towers 24. The height of longer side wall 32 preferably coincides with the tower height. Although a longer side wall 32 may be provided on each side of the element, it is preferred to provide a side wall 32 on only one side while on the opposite side of the element the side wall 32A of the next adjacent element saves the light blocking function at the adjacent sides of the first and second elements.

Although the presence of a first or forward side wall 32 is desireable on each side of the display element an individual display element will have only one, shown here on the right side. The opposed or left hand side wall 32, to the one shown is provided by the right hand side wall 32A of the element to the left of that under discussion. The presence, in an array, of this side wall 32A is indicated in dotted form on FIGS. 2–6. Thus each side wall 32 or 32A acts as a side wall for the elements on each side.

In relation to the walls of the element, the terms 'side', 'end', 'top', 'bottom', 'left' and 'right' refer to the preferred orientation of the element, as shown in the drawings, but are not intended to limit the broad coverage of the invention.

Approximately midway along the inside of the bottom wall 22E and approximately midway along the inside of the left side wall 22S are the cores 34B and 34L which respectively act to drive the permanent magnet 36 on the rotor, to be described.

Figure 4:
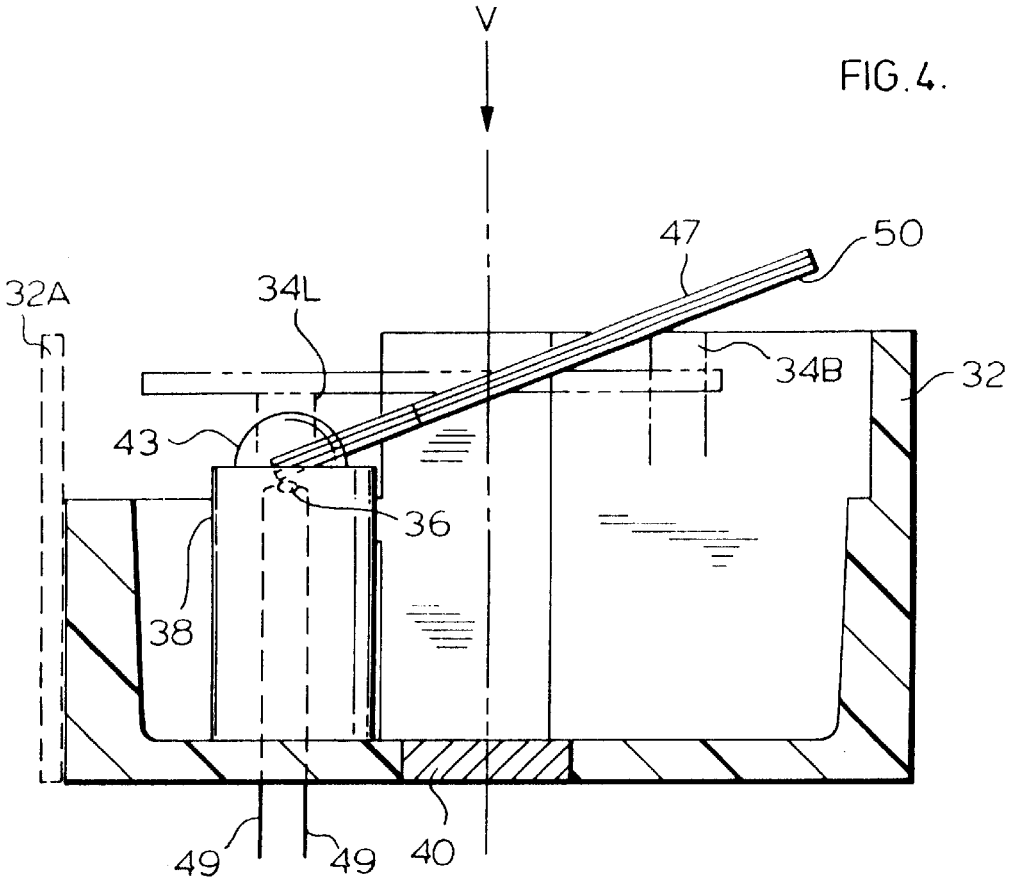
FIG. 4 is a section taken along the lines 4—4 of FIG. 2.

The ends of cores 34B, 34L are preferably symmetrically disposed (as viewed in the viewing direction) on each side of the rotation axis, and in the preferred embodiment act as stops for the disk 30. As shown in FIG. 4 core 34B projects from the base farther than core 34L for reasons to be discussed. Mechanical stops separate from the cores can, if desired be provided by cooperating members on the stator and rotor providing the same stopping positions. At preferably, the upper left corner of the base, an LED 36 in a transparent lens is mounted to project forwardly from the base in the viewing direction. As with other possible spindle orientations for example parallel to one of the opposed sides the LED will be designed to radiate widely. A shroud 38 is preferably provided extending from the stator base preferably to a position a little forward of the LED 36 to set an upper limit on its radition angle from the viewing direction. The shroud thus preferably covers the rearward portion of lens 43. A bias magnet 40 having a forward, rearward axis is provided in the centre of the base. This is to provide a resultant field in combination with the field between the ends of cores 34L and 34B to improve the starting torque of the disk. This drive will not be described in detail here and is described in U.S. Pat. No. 3,518,664 dated Jun. 30, 1970 to M. K. Taylor, and is incorporated herein by reference.

The cores 34B, 34L project rearwardly from the base to each receive windings 42. The cores which are of relatively high remanence material and are bridged at their rearward ends by soft iron members 44W, carry the leads 45 to pulse the windings to set the cores in the desired polarity and react with disk magnet 21 to flip the disk. As is well known, the high remanence cores will hold their polarity to retain the disk in its latest pulsed orientation and to return it to this orientation if it is mechanically disturbed. Pin 46 also extending rearwardly from the base of the stator carries the leads 48 to energize the cores. In the operation of the invention, the LED is kept continuously on regardless of disk orientation, by power from a source, not shown, to leads 49, and is masked against transmission of its rays in the viewing direction by the rotor 30 to be described, when in the OFF orientation.

Figure 1:
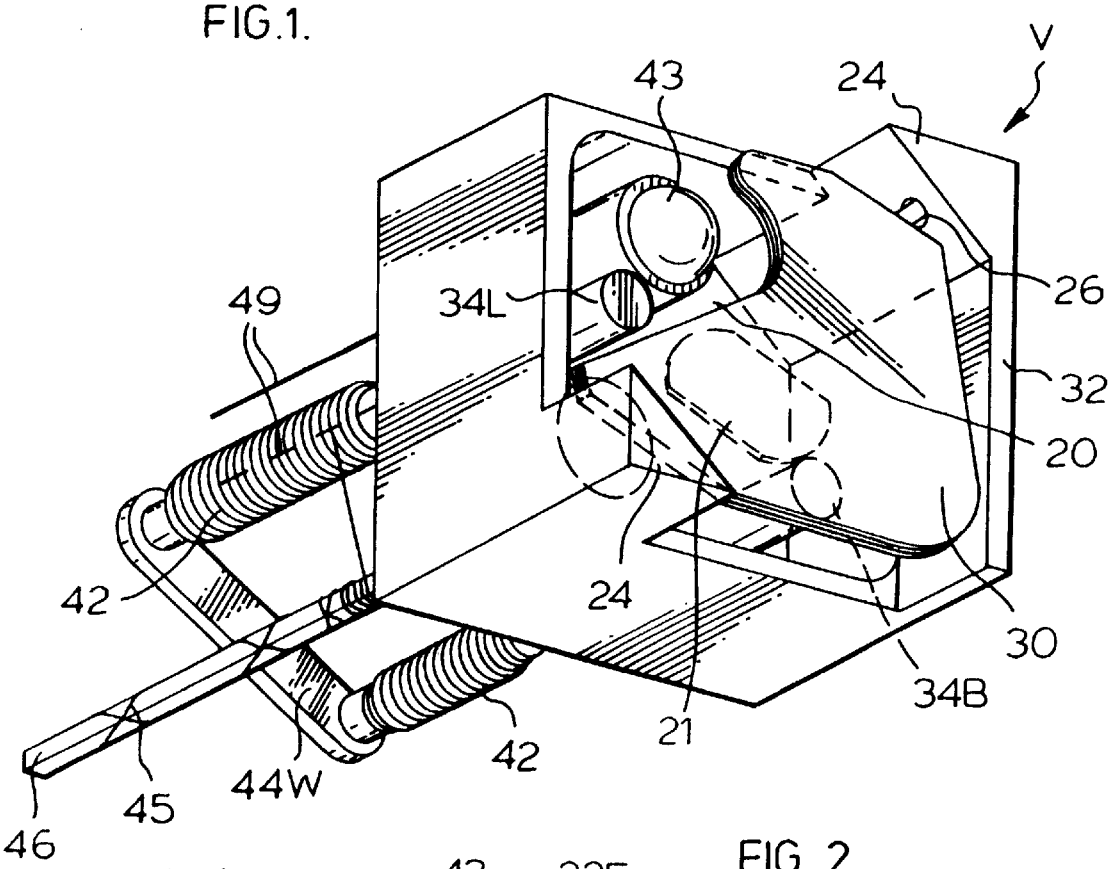
FIG. 1 is a perspective view of a display element in accord with the invention.
Figure 2:
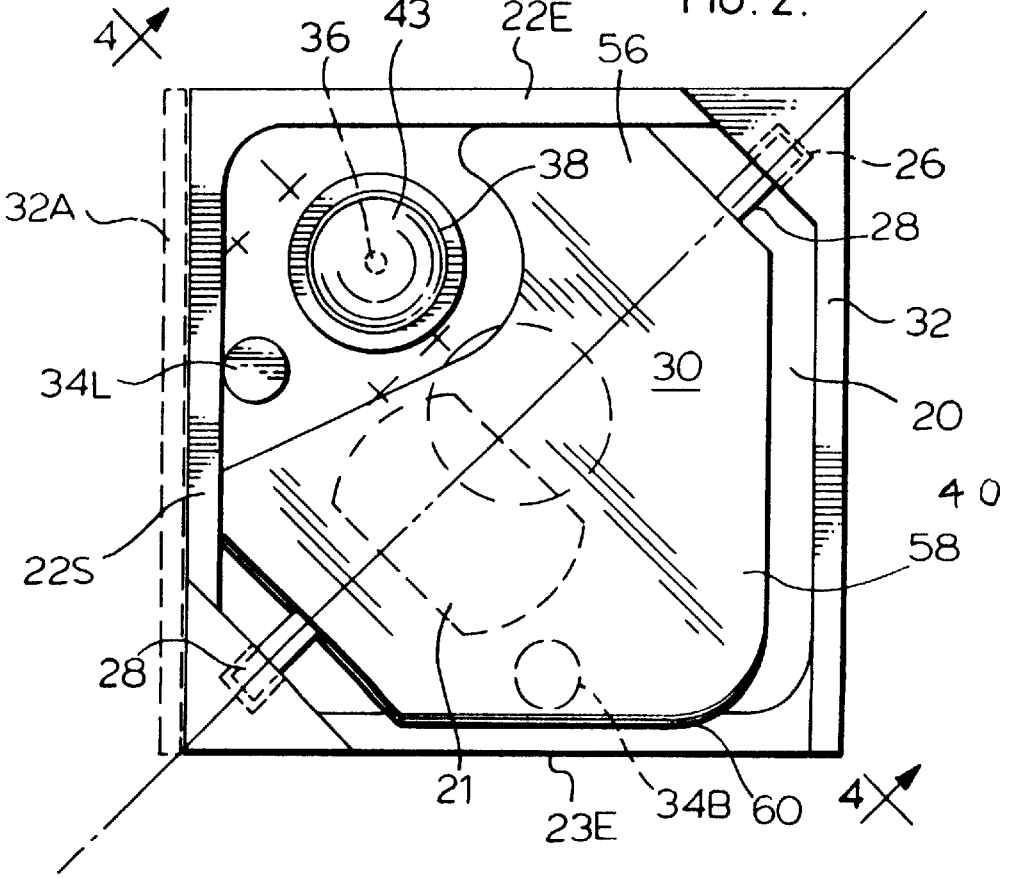
FIG. 2 is a front view (that is, looking in the viewing direction) of the element of FIG. 1 in ON position.
Figure 3:
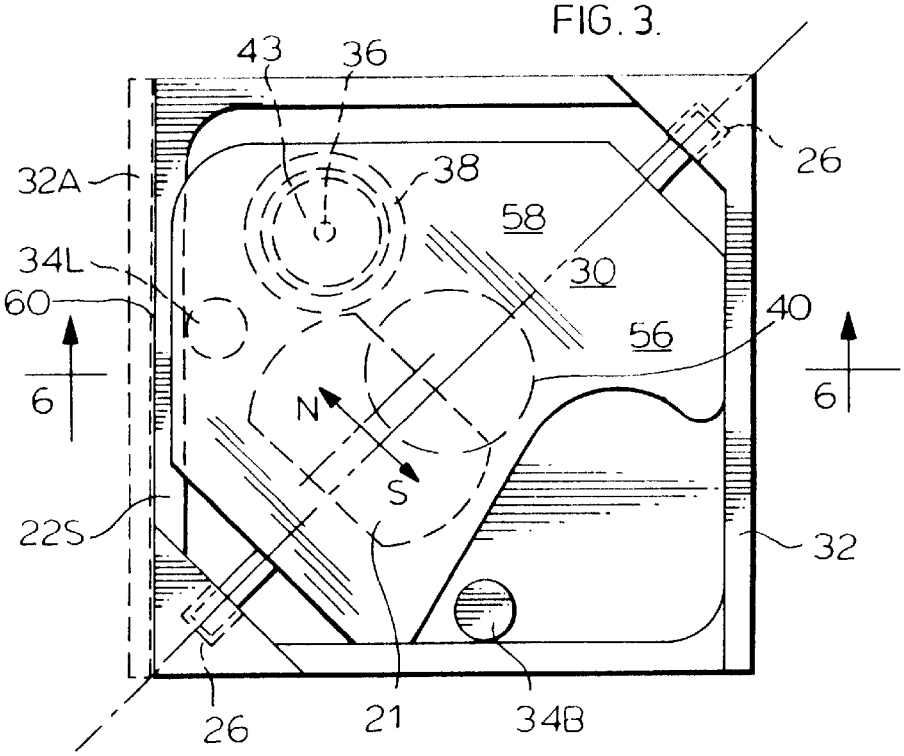
FIG. 3 is a front view of the element of FIG. 1 in the OFF position.

The rotor 30 is shown in 'set' or ON position in FIGS. 1 and 2 and in 'reset' or OFF position in FIGS. 3 and 6. The disk 30 is provided with a bright reflecting side 47 facing the viewing direction in the ON position and a dark light-absorbent side 50 facing the viewing direction in the reset or OFF position. The median plane of the disk, at least in ON position will preferably deviate by an angle of about 20° from the parallel to base 20, but this will not be significant to the viewer. The deviation is in the rotational sense toward the other limiting position so that the rotation is about 165° between limiting positions instead of 180°.

The disk is preferably made in accord with the teachings of U.S. Pat. Nos. 3,953,274, Winrow et al and 3,871,945, Winrow et al, whose teachings are included herein by reference, such a disk having a central and two outer layers (each of which may be composed of sub layers) with a recess cut in the central layer 31 to receive the magnet 21 which is approximately the thickness of the central layer. The ON side of the disk is usually a bright vinyl. The OFF side of the disk is usually dull black, preferably having a graphite coating to avoid static electricity build up which might otherwise interfere with the dot operation. The stator surfaces which form the background for the disk are coloured to conform to the disk surface 50.

The spindles 29 are preferably extensions of a mylar central layer.

The cores are always oppositely polarized, with the polarity reversed at each pulse of the coils. The disk magnet 21 defines a magnetic axis N-S transverse to the disk axis and lies in the median plane of the disk. The disk limiting positions are chosen so that, with each reversal of the cores' polarity, the disk will rotate about 165° between ON and OFF positions.

The surfaces of the stator forming a background to the disk, in either its ON or OFF orientation, are of a dark, not highly reflectant, colouring, matching as nearly as possible the OFF side of the disk.

The disk may be slightly curved but is nearly planar and hence is considered as defining a median plane.

The disk is shaped to conform generally to the square outline of the housing. The disk is considered as a sector on each side of the axis. In the ON position of the disk, the LED remote sector 56 is generally of the shape of one half a diagonally divided square, with truncated end corners to clear the towers 24. Section 56 will rotate forwardly of the stator between OFF and ON position. The LED adjacent sector 58 will rotate rearwardly between ON and OFF position and hence is cut away to allow it to clear stator components including the cores and the LED.

In OFF position the stop (core 34L) is arranged so that the disk is approximately perpendicular to the viewing axis and the edge 60 is preferably shaped to overlap short wall 22S which provides a labyrinthine path including high wall 32A for the escape of radiation to the left side of the stator. The same overlap cannot be provided on the right side 56 of the disk since the right hand edge segment must rotate downwardly past wall 32. The rightward escape of light in the OFF position is reduced or prevented, by the disk which (FIG. 6) covers the large area to the right of the LED and by the high wall 32.

In ON position, the disk is preferably maintained at a greater angle to the base, and at less than 90° to the viewing direction. The reason is that the full sector 58 of the disk is heavier than the cut out sector 56 The magnet 21 is also eccentrically mounted (as hereinafter discussed) so that most of its weight is in the sector 58. The summed imbalance adds to the torque required to move the full semi plane up from ON to OFF orientation. The core 34B end (or other alternate stop) is located forwardly of its counterpart core 34L end to give the disk magnet 21 a better starting torque. On the other hand when moving from OFF to ON, the disk rotation is aided by gravity and may be limited by its stop 34L to a vertical position. The presence of the bias magnet 40 does, in this orientation (as in the other), improve the starting torque in leaving OFF position.

The magnet is located so that most of its length is in sector 58. The primary reason for this is to increase the distance between the pole of magnet 21 in sector 56 and the bias magnet 40 as the former passes the latter; to avoid having the bias magnet 40 unduly affect the disk's rotational velocity.

It is further noted that if the disk magnet 21 is too close to a core end in either limiting position, the disk magnet because of its higher coercivity will demagnetize the core magnet, causing latching. Accordingly, the extent and location of the disk magnet is chosen to avoid this.

FIG. 5 shows a preferred arrangement where 7 display elements are combined in a single plastic moulding. Such 7 elements are preferably oriented as a column. The reason is that the bus mount for the array may curve in plan view. Thus the 7 element columns may be conveniently arranged to comply with this curvature. Alternatively, with such a curved arrangement the display elements may be arranged in planar sub-array and the sub-arrays arranged as chords of the curved bus surface. Of course, any other number of elements than 7 may be combined in any single moulding. The area for a bus destination sign may thus be filled by a combination of multiple and single element units.

FIGS. 10A and 10B which are schematic longitudinal vertical sections along a bus for comparison of an array in accord with the invention (FIG. 10B) with a common prior arrangement.

In FIG. 10A a flip disk array A without LED's must, in a bus B be set back from the windshield C to allow (for use at night and during poor lighting) illumination of the disks in the array by a halogen tube D. In FIG. 10B the array AI is provided with disks augmented by LED's in accord with the invention and FIGS. 1–9 so it may be moved much closer to the windshield C for better viewing. The closer location of the array to the windshield renders preferable the use of display elements in single vertical columns to conform if necessary to a curved or otherwise irregular windshield contour in plan view.

I claim:

1. Display element for viewing in a viewing direction, comprising a stator and a rotor, said rotor being a disk mounted on said stator to rotate about an angle between ON and OFF limiting positions about an axis generally perpendicular to the viewing direction, said rotor displaying bright and dark sides in said viewing direction in ON and OFF limiting positions, respectively, means for causing rotation of said disk about a rotation axis between ON and OFF limiting positions, an LED mounted on the stator having a lens with a forward end projecting forwardly therefrom, said lens projecting forwardly of said disk when the latter is in ON position and with said LED rearwardly of said disk.

2. A display element as claimed in claim 1 wherein said stator encompasses an approximate square when viewed in the viewing direction, and wherein said disk is mounted so that said axis runs substantially diagonally relative to said approximate square.

3. An array of display elements as claimed in claim 2 wherein said display elements are arranged in rows and columns and so that the sides of said squares are parallel to said rows and columns.

* * * * *